US006946998B2

(12) United States Patent
Maarala et al.

(10) Patent No.: US 6,946,998 B2
(45) Date of Patent: Sep. 20, 2005

(54) RADIO APPARATUS WITH A PLANAR ANTENNA

(75) Inventors: Mika Maarala, Oulu (FI); Antti Häggman, Oulu (FI); Ari Kalliokoski, Kello (FI); Antti Lilja, Oulunsalo (FI)

(73) Assignee: Nokia Corporation, Espoo (FI)

( * ) Notice: Subject to any disclaimer, the term of this patent is extended or adjusted under 35 U.S.C. 154(b) by 21 days.

(21) Appl. No.: 10/786,390

(22) Filed: Feb. 25, 2004

(65) Prior Publication Data

US 2004/0217909 A1 Nov. 4, 2004

(30) Foreign Application Priority Data

Feb. 26, 2003 (EP) ..... 03100466

(51) Int. Cl.[7] ..... H01Q 1/38

(52) U.S. Cl. ..... 343/700 MS; 343/829; 343/846; 343/876

(58) Field of Search ..... 343/700 MS, 829, 343/846, 876; H01Q 1/38

(56) References Cited

U.S. PATENT DOCUMENTS

| | | | | | |
|---|---|---|---|---|---|
| 5,276,920 | A | * | 1/1994 | Kuisma | 455/101 |
| 5,486,836 | A | * | 1/1996 | Kuffner et al. | 343/700 MS |
| 6,255,994 | B1 | * | 7/2001 | Saito | 343/700 MS |
| 6,285,893 | B1 | | 9/2001 | Keirinbou | |
| 2002/0094789 | A1 | | 7/2002 | Harano | |
| 2004/0041733 | A1 | * | 3/2004 | Milosavljevic | 343/700 MS |

FOREIGN PATENT DOCUMENTS

| | | |
|---|---|---|
| JP | 09247031 | 9/1997 |
| JP | 11008512 | 1/1999 |
| JP | 2002 016433 | 1/2002 |

* cited by examiner

*Primary Examiner*—Don Wong
*Assistant Examiner*—Marie Antoinette Cabucos
(74) *Attorney, Agent, or Firm*—Hollingsworth & Funk, LLC

(57) ABSTRACT

A method of changing an antenna pattern in a radio apparatus and a radio apparatus comprising a planar antenna structure with a first and a second plane are provided. In the solution both planes are arranged to act as a radiator plane and as a ground plane and the apparatus comprises means for interchanging the usages of the planes.

14 Claims, 3 Drawing Sheets

RADIO APPARATUS WITH A PLANAR ANTENNA

FIELD

Figure 1:
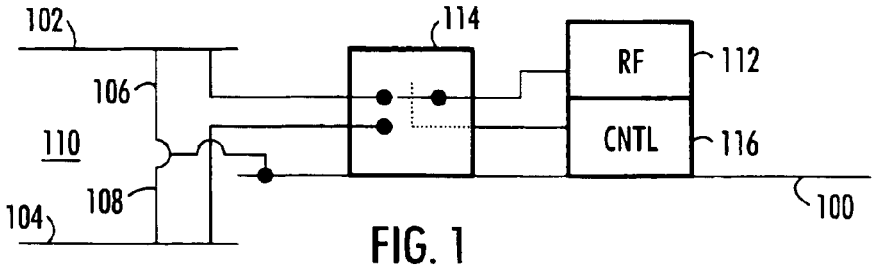

The invention relates to a radio apparatus comprising a planar antenna structure.

BACKGROUND

In portable and especially in hand-held radio devices the trend is to minimize the size of the device. Due to size requirements, internal antennas, i.e. antennas placed inside the cover of the device, have become more common.

Internal antennas are usually implemented using a planar inverted F-antenna (PIFA) structure. A PIFA antenna comprises a radiator plane and a ground plane, and some insulator between the planes, typically air. An RF signal is taken to the radiator plane through a radio signal feed. Both planes are connected to ground.

The performance of the antenna of a portable radio apparatus, such a as mobile phone, is sensitive to the objects nearby the phone. Objects near the antenna may cause losses in the transmitted and received signals. Thus, the mobile phone and the antenna are designed assuming that the phone is used in the most common way, i.e. held against the ear of the phone user. Traditionally the usage position of a phone is unambiguous, the user having a phone call always keeps the phone in the same position. This is due to the positions of the microphone and the speaker in the phone. To keep the body loss of the signal as small as possible, the antenna is designed in such a way that the antenna radiation pattern points away from the user.

However, as new different phone models are entering the market and the use of hands free equipment is increasing, the assumption regarding the traditional usage position of a mobile phone is no longer valid. For example, when hands free equipment is used the mobile phone can be situated in a pocket or on a table during a call. This can cause severe degradation in antenna performance due to increased body or object loss.

BRIEF DESCRIPTION OF THE INVENTION

An object of the invention is to provide a radio apparatus with an improved antenna structure. According to an aspect of the invention, there is provided a radio apparatus comprising a planar antenna structure with a first and a second plane. Both planes are arranged to act as a radiator plane and as a ground plane and the apparatus comprises means for interchanging the usages of the planes.

According to an aspect of the invention, there is provided a method of changing an antenna pattern in a radio apparatus comprising a planar antenna structure with a first and a second plane, the method comprising interchanging the usages of the first and second planes as a radiator plane and as a ground plane.

In an embodiment of the invention, the plane used as a radiator plane is selected on the basis of signal quality measurements made using both planes as radiator planes in turn. In another embodiment, the selection can be made on the basis of proximity sensors which detect obstructions near the radio apparatus. Also other sensors can be used for selecting the plane.

Preferred embodiments of the invention provide several advantages. With the ability to use both planes of the planar antenna as radiator planes, it is possible to choose between two antenna radiation patterns. In a preferred embodiment of the invention, the antenna performance can thus be optimised by choosing a radiation pattern that points away from obstacles near the phone and gives a better signal quality.

In an embodiment of the invention, the selection of the plane used as a radiator plane is made on the basis of the carrier frequency used. The planes of the PIFA structure may have different radiating element layouts, and the layouts of the planes may be optimised for different carrier frequencies. This increases the signal quality and reduces the size of the planes.

LIST OF DRAWINGS

Figure 2A:
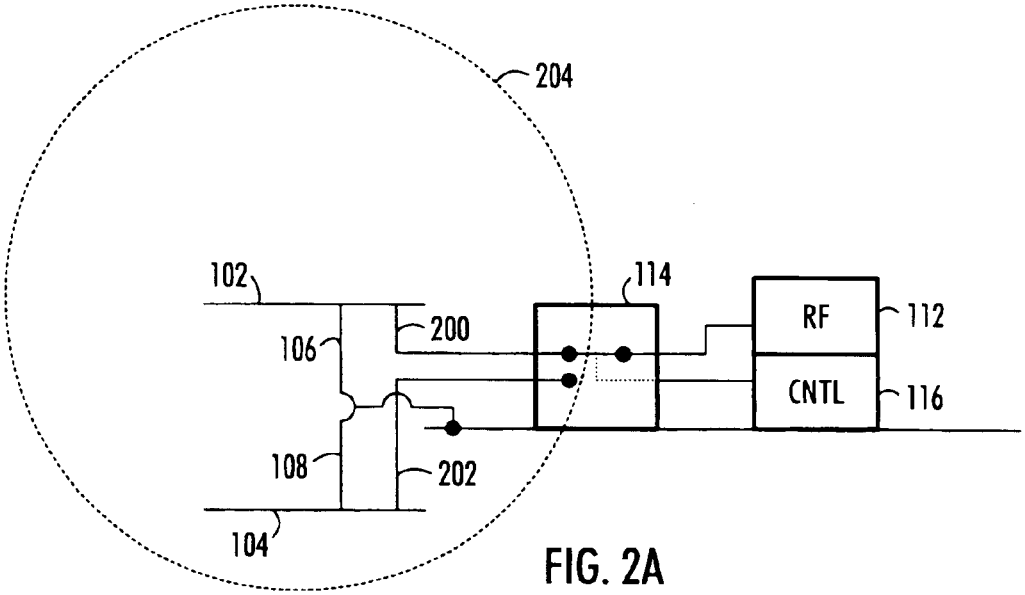
Figure 2B:
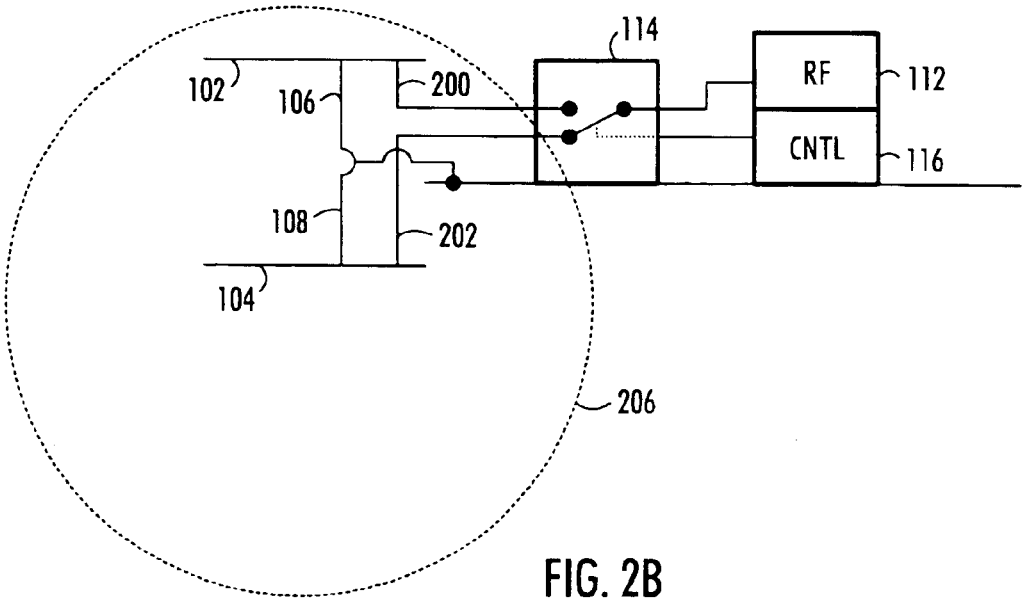
Figure 3A:
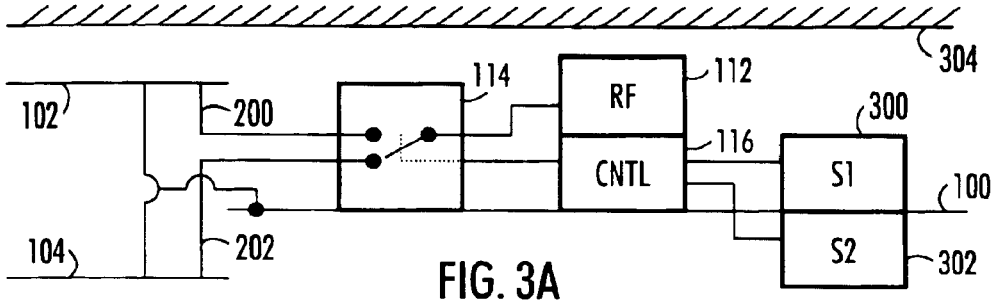
Figure 3B:
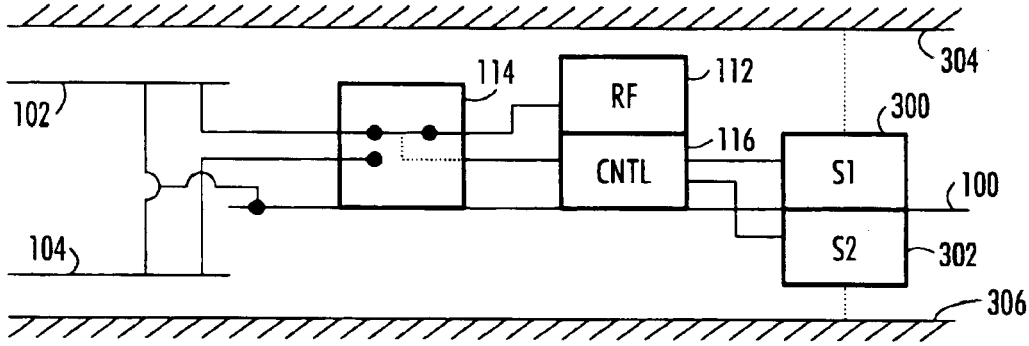
Figure 4:
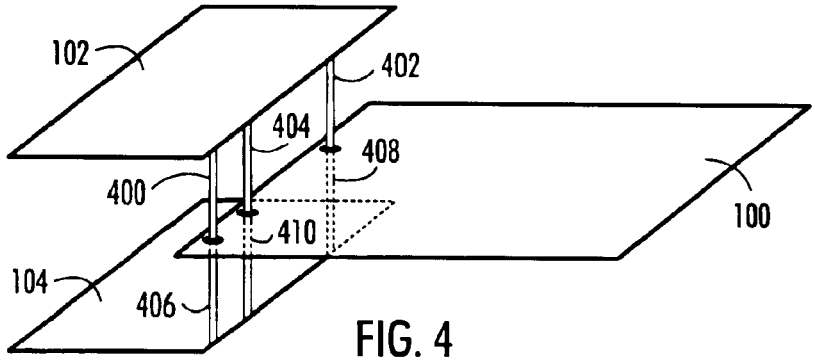
Figure 5:
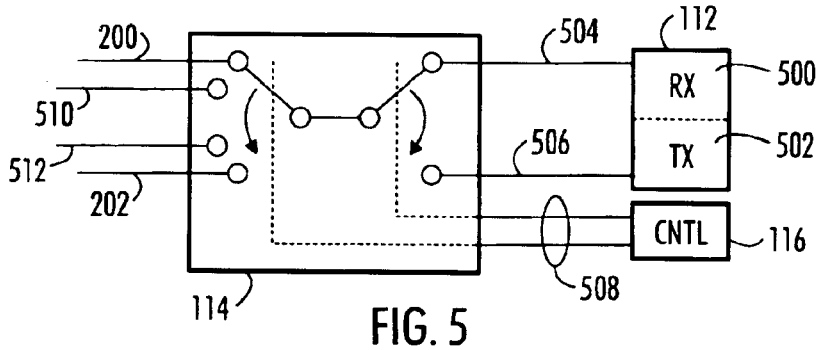

In the following, the invention will be described in greater detail with reference to the preferred embodiments and the accompanying drawings, in which FIG. 1 illustrates the structure of an embodiment of a radio apparatus, FIGS. 2A and 2B illustrate the changing of the usage of the planes of the planar antenna structure, FIGS. 3A and 3B illustrate the structure of another embodiment of a radio apparatus, FIG. 4 illustrates the number of feeds to the planes, FIG. 5 shows an example of an antenna switch module and FIGS. 6A to 6D illustrate the embodiments of the invention.

DESCRIPTION OF EMBODIMENTS

FIG. 1 illustrates an example of a radio apparatus according to an embodiment of the invention. The apparatus comprises a printed wired board 100, which provides an electrical ground for the device. The apparatus comprises a planar antenna structure with first 102 and second 104 planes. The planes are connected to the ground with grounding feeds 106, 108. The space 110 between the planes is air or other dielectric material. The planes comprise radiating elements having similar or dissimilar electrical properties.

The apparatus comprises an RF unit 112, which processes signals to be transmitted and received. The operation of RF unit is known to one skilled in the art and not discussed here in detail. The apparatus comprises typically base band and digital parts, but these are not presented here for simplicity.

The RF unit is connected to an antenna switch module 114. The antenna switch module has as an output at least one radio signal feed 106, 108 to each plane 102, 104. The switch module is controlled by a controller 116, which typically is realized using a digital processor or discrete components and appropriate software. The controller 116 controls the operation of the switch 114 so that radio signal feeds of either planes are connected to the RF unit, while the radio signal feeds of the other plane are left unconnected. Thus, the plane whose radio signal feeds are connected to the RF unit 112 via the switch 114 is acting as a radiator plane, while the plane whose radio signal feeds are left unconnected by the switch is acting as a ground plane.

It should be noted that although in FIG. 1 the planes 102, 104 are situated symmetrically in relation to the printed wired board 100, this is not necessarily always the case.

FIG. 2A illustrates the case when the plane 102 is acting as a radiator plane and the plane 104 is acting as a ground plane. The controller 116 controls the antenna switch module 114 to connect the radio signal feed 200 of the plane 102 to the RF unit 112. The radio signal feed 202 of the plane 104 is left unconnected. The ground feeds 106 and 108 are typically connected to both planes. The antenna pattern 204 of the antenna structure points mainly to the side of the radiator plane 102.

FIG. 2B illustrates the case when the plane 104 is acting as a radiator plane and the plane 102 is acting as a ground plane. The controller 116 controls the antenna switch module 114 to connect the radio signal feed 202 of the plane 104 to the RF unit 112. The radio signal feed 200 of the plane 102 is left unconnected. The ground feeds 106 and 108 are again typically connected to both planes 102, 104. The antenna pattern 206 of the antenna structure points again mainly to the side of the radiator plane 104, which is on the other side of the apparatus compared with the situation of FIG. 2A.

FIG. 3A illustrates the structure of another embodiment of a radio apparatus. The apparatus may comprise at least two proximity sensors 300, 302. The sensors are arranged to detect any surfaces nearby the radio apparatus. In a preferred embodiment of the invention, the sensors are located on different sides, preferably on opposite sides of the apparatus. In a preferred embodiment, the sensors are on the same sides of the apparatus as the planes of the planar antenna structure. The sensors are known as such to one skilled at the art. They may be realised using optical or touch sensors, for example. The sensors are arranged to measure the proximity of objects nearby the apparatus at the command of the controller 116. For example, at the beginning of a connection, the controller 116 may require a measurement result from the sensors 300, 302. The sensors report the measurements to the controller.

In an embodiment of the invention, the apparatus comprises one sensor which is connected to different sides of the apparatus. Thus the required measurements can be performed using only one sensor. In the following examples, however, two sensors are described for simplicity.

In the example of FIG. 3A, there is an object 304, for example a table or a part of a human body, which is detected by the sensor 300. Sensor 302, on the other side of the apparatus, does not, however, detect any obstacles near the apparatus. This kind of situation may occur when the apparatus is lying on a table, for example. The sensors 300, 302 signal the measurement results to the controller, which on the basis of the measurements controls the antenna switch module 114 to connect the radio signal feed 202 of the plane 104 to the RF unit 112. Thus, the plane 104 is in this case used as the radiator plane, and the plane 102 is used as the ground plane. With this arrangement the antenna radiation pattern points mainly outwards from the object 304 and the quality of the connection is optimised.

If the object 304 were on the other side of the apparatus, the sensor 302 would in that case detect the object and the sensor 300 would indicate free space on the other side of the apparatus. The controller would thus control the antenna switch module 114 to connect the radio signal feed 200 of the plane 102 to the RF unit 112. Thus, the plane 102 is in this case used as the radiator plane, and the plane 104 is used as the ground plane. With this arrangement the antenna radiation pattern would again point outwards from the object 304.

FIG. 3B illustrates another situation where there are objects 304, 306 on both sides of the radio apparatus. In this case both sensors 300, 302 send a signal to the controller that indicates an object in front of the sensor. The controller is thus unable to make the decision about the optimal direction of antenna pattern on the basis of the sensors. In an embodiment of the invention the controller starts communication using a plane as a radiator plane, for example plane 102. The controller performs signal quality measurements during communication. After measurements have been performed, the controller selects the plane 104 as the radiator plane, and again performs signal quality measurements. The controller then compares the measurement results and selects the plane that gave the best signal quality as the radiator plane for the rest of the communication.

The signal quality measurement performed by the controller may be for example a RSSI (Received Signal Strength Indicator) measurement, where the strength of the signal sent by a base station is measured. The signal quality measurement may also comprise measuring signal-to-interference ratio or other signal quality parameters.

In an embodiment, the apparatus does not comprise sensors at all, but the selection of the radiator plane is made using signal quality measurements.

In an embodiment of the invention, the controller does not perform measurements itself but sends a message to the base station the apparatus is communicating with, the message comprising a request for the base station to perform measurements and signal the results to the controller.

In an embodiment, the proximity sensors 300, 302 perform measurements at given intervals. Also the signal quality measurements may be performed periodically. Thus the direction of the antenna pattern may be optimised during a connection, not only at the beginning of a connection.

If the radio apparatus is configured to communicate on more than one frequency band, for example on GSM, on 900 MHz and on 1800 MHz frequency bands, the planes of the planar antenna may be optimised to different bands. Thus, the planes may comprise radiating elements having dissimilar electrical properties. In such a case the controller may select the plane to act as the radiator plane on the basis of the frequency plane the communication is using. This solution minimises the size of the planar antenna and thus the size and weight of the apparatus as a whole.

FIG. 4 illustrates an example of a radio apparatus where there are several feeds to the planes of the planar antenna structure. FIG. 4 shows a printed wired board 100 and a planar antenna with a first 102 and a second 104 plane. The apparatus comprises a first ground feed 400 and a second ground feed 402 to the plane 102. There is one signal feed 404 to the plane 102. Correspondingly the apparatus comprises a first ground feed 406, a second ground feed 408 and a signal feed 410 to the plane 104. The apparatus may also comprise more than two grounding feeds.

In the case where plane 102 acts as a radiator, the feed 404 is connected by the antenna switch module to the RF-unit (not shown). Ground feed 402 is connected to the signal ground provided by the printed wired board 100 but ground feed 400 is unconnected. Regarding plane 104, the signal feed 410 is unconnected, but both ground feeds 406, 408 are connected to the signal ground.

The apparatus may also comprise more than one signal feeds to each plane 102, 104. There may be a signal feed for each frequency band supported by the apparatus, for example. The signal feeds can be connected to different parts of the plane.

FIG. 5 illustrates a more detailed example of the antenna switch module 114 and its controlling. In this example it is assumed that the RF unit 112 of the radio apparatus comprises a receiver 500 and a transmitter 502. The antenna is switched between the transmitter part and the receiver part in turn. The inputs of the antenna switch module comprise a connection 504 to the receiver, a connection 506 to the transmitter, and the control signals 508 from the controller 116. The outputs of the module comprise the signal feeds 200, 202, 510, 512 to the planes of the planar antenna. In an embodiment, there are more than one signal feeds to a plane. In FIG. 5 feeds 200 and 510 are connected to a first plane and feeds 202 and 512 to a second plane. Different feeds may be used for example for different carrier frequencies. On the basis of the control signals 508 from the controller 116 the module switches either connection 504, 506 to the selected feed of the selected plane acting as the radiator plane. The embodiments of the invention may also be applied in the case where the transmitter and the receiver are active simultaneously. In this case there is no need for switching transmitter and receiver parts, only the switching between the planes is needed.

Figure 6A:
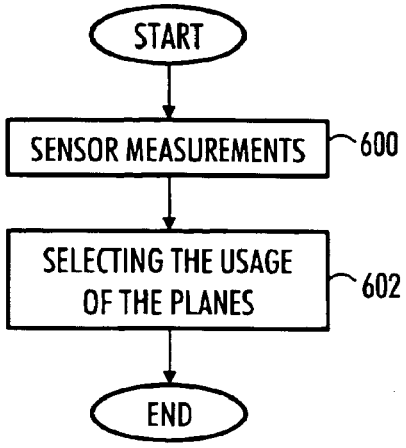

FIGS. 6A to 6D illustrate some embodiments of the method according to the invention. FIG. 6A illustrates the plane usage selection based on sensors. In step 600 the apparatus performs measurements with at least one sensor, preferably for different sides of the apparatus. The measurement results reveal the obstacles near the apparatus. In step 602 the usage of the planes is selected on the basis of the sensor measurements.

Figure 6B:
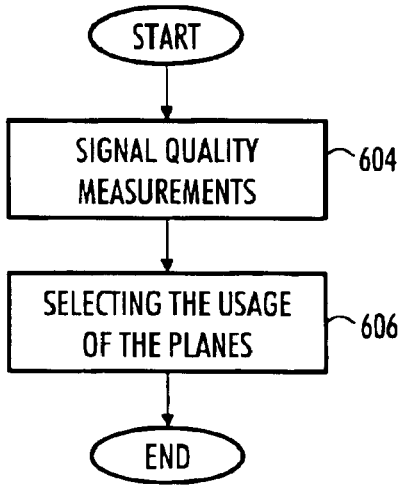

FIG. 6B illustrates the plane usage selection based on quality measurements. In step 604 the controller of the apparatus performs signal quality measurements with different plane usages. In step 606 the usage of the planes is selected on the basis of the quality measurements. The plane usage arrangement giving the best signal quality is selected for use in communication.

Figure 6C:
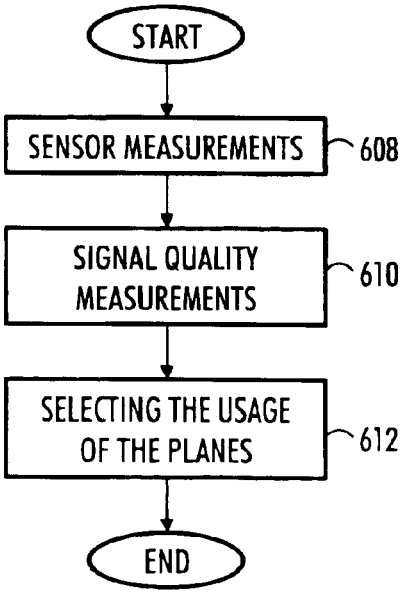

FIG. 6C illustrates the plane usage selection based on combined sensor and signal quality measurements. In step 608 the apparatus performs measurements with at least one sensor, preferably for different sides of the apparatus. If the measurement results do not reveal that there are obstacles on more than one side near the apparatus, the controller of the apparatus performs signal quality measurements with different plane usages in step 610. In step 612 the usage of the planes is selected on the basis of the measurements.

Figure 6D:
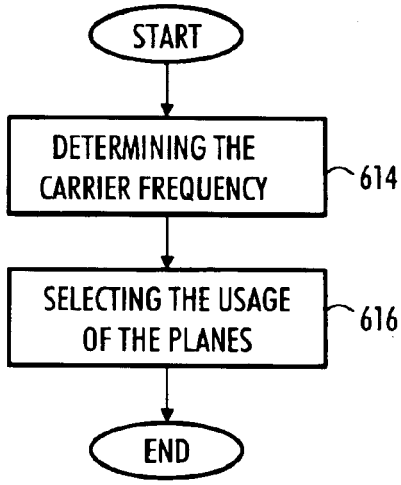

FIG. 6D illustrates the plane usage selection based on the carrier frequency. In step 614 the controller of the apparatus determines the carrier frequency to be used in communication. In step 616 the usage of the planes is selected on the basis of this information.

Even though the invention is described above with reference to an example according to the accompanying drawings, it is clear that the invention is not restricted thereto but it can be modified in several ways within the scope of the appended claims.

What is claimed is:

1. A radio apparatus comprising a planar antenna structure with a first and a second plane, wherein both planes are arranged to act as a radiator plane and as a ground plane and the apparatus comprises means for interchanging the usages of the planes.

2. A radio apparatus of claim 1, further comprising at least one radio signal feed and at least one grounding feed to the first plane, and at least one radio signal feed and at least one grounding feed to the second plane.

3. A radio apparatus of claim 1, further comprising means for switching a radio signal to at least one feed of the plane acting as a radiator plane, and blocking the radio signal from all feeds of the plane acting as a ground plane.

4. A radio apparatus of claim 1, further comprising means for selecting the usage of planes on the basis of signal quality measurements.

5. A radio apparatus of claim 1, further comprising at least one sensor for sensing which side of the apparatus is covered and means for selecting the usage of planes on the basis of the sensor signals.

6. A radio apparatus of claim 5, further comprising sensors on different sides of the apparatus.

7. A radio apparatus of claim 1, further comprising means for selecting the usage of planes on the basis of the frequency of the radio signal.

8. A radio apparatus of claim 1, the planes comprising radiating elements having similar electrical properties.

9. A radio apparatus of claim 1, the planes comprising radiating elements having dissimilar electrical properties.

10. A method of changing an antenna pattern in a radio apparatus comprising a planar antenna structure with a first and a second plane, comprising: interchanging the usages of the first and second planes as a radiator plane and as a ground plane.

11. A method of claim 10, further comprising: performing signal quality measurements and interchanging the usage of planes on the basis of the measured signal quality.

12. A method of claim 10, further comprising: sensing which side of the apparatus is covered by at least one sensor and selecting the usage of planes on the basis of the sensor signals.

13. A method of claim 12, further comprising: performing measurements with sensors on different sides of the apparatus.

14. A method of claim 10, further comprising: interchanging the usage of planes on the basis of the used carrier frequency.

* * * * *